US009728312B2

(12) United States Patent
Fujikura et al.

(10) Patent No.: US 9,728,312 B2
(45) Date of Patent: Aug. 8, 2017

(54) NON-ORIENTED ELECTRICAL STEEL SHEET AND MANUFACTURING METHOD THEREOF

(71) Applicant: NIPPON STEEL & SUMITOMO METAL CORPORATION, Tokyo (JP)

(72) Inventors: Masahiro Fujikura, Tokyo (JP); Yoshiyuki Ushigami, Tokyo (JP); Tesshu Murakawa, Tokyo (JP); Shinichi Kanao, Tokyo (JP); Makoto Atake, Tokyo (JP); Takeru Ichie, Tokyo (JP); Kojiro Hori, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 27 days.

(21) Appl. No.: 14/354,631

(22) PCT Filed: Nov. 9, 2012

(86) PCT No.: PCT/JP2012/079066

§ 371 (c)(1),
(2) Date: Apr. 28, 2014

(87) PCT Pub. No.: WO2013/069754

PCT Pub. Date: May 16, 2013

(65) Prior Publication Data

US 2014/0238558 A1 Aug. 28, 2014

(30) Foreign Application Priority Data

Nov. 11, 2011 (JP) ..... 2011-247637
Nov. 11, 2011 (JP) ..... 2011-247683

(51) Int. Cl.
*H01F 1/147* (2006.01)
*C22C 38/00* (2006.01)
(Continued)

(52) U.S. Cl.
CPC ..... *H01F 1/14775* (2013.01); *C21D 8/0263* (2013.01); *C21D 8/1222* (2013.01);
(Continued)

(58) Field of Classification Search
CPC ..... H01F 1/14775; C21D 8/0263
See application file for complete search history.

(56) References Cited

U.S. PATENT DOCUMENTS 6,425,962 B1 7/2002 Kawamata et al.
2008/0060728 A1* 3/2008 Kohno et al. ..... 148/645
(Continued)

FOREIGN PATENT DOCUMENTS

CN 1293261 A 5/2001
EP 0 527 495 A1 2/1993
(Continued)

OTHER PUBLICATIONS

Extended European Search Report dated Jun. 5, 2015, issued in corresponding European Patent Application No. 12847037.4.
(Continued)

*Primary Examiner* — Rebecca Lee
(74) *Attorney, Agent, or Firm* — Birch, Stewart, Kolasch & Birch, LLP

(57) ABSTRACT

A non-oriented electrical steel sheet containing: in mass %, C: 0.005% or less; Si: 0.1% to 2.0%; Mn: 0.05% to 0.6%; P: 0.100% or less; and Al: 0.5% or less, in which 10 pieces/$\mu m^3$ or less in number density of non-magnetic precipitate AlN having an average diameter of 10 nm to 200 nm are contained, and an average magnetic flux density B50 in a rolling direction and in a direction perpendicular to rolling is 1.75 T or more. This non-oriented electrical steel sheet can be manufactured by two methods of a method of performing hot rolling annealing at a temperature of 750° C. to an Ac1 transformation point and a method of setting a coil winding
(Continued)

temperature to 780° C. or higher and performing self annealing.

4 Claims, 5 Drawing Sheets

(51) Int. Cl.

| | |
|---|---|
| ***C22C 38/06*** | (2006.01) |
| ***C22C 38/60*** | (2006.01) |
| ***H01F 1/16*** | (2006.01) |
| ***C22C 38/02*** | (2006.01) |
| ***C22C 38/04*** | (2006.01) |
| ***C21D 8/02*** | (2006.01) |
| *C21D 8/12* | (2006.01) |

(52) U.S. Cl.

CPC ..... *C21D 8/1233* (2013.01); *C21D 8/1272* (2013.01); *C22C 38/00* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/16* (2013.01); *C21D 8/12* (2013.01); *C21D 2201/03* (2013.01); *H01F 1/14791* (2013.01)

(56) References Cited

U.S. PATENT DOCUMENTS

| | | | | |
|---|---|---|---|---|
| 2008/0121314 | A1* | 5/2008 | Choi | C21D 8/1205 148/111 |
| 2011/0056592 | A1* | 3/2011 | Arita | C21D 8/1222 148/504 |
| 2011/0094699 | A1 | 4/2011 | Miyazaki et al. | |

FOREIGN PATENT DOCUMENTS

| | | | | | |
|---|---|---|---|---|---|
| JP | 54076422 | A | * | 6/1979 | C21D 9/46 |
| JP | 56-38420 | A | | 4/1981 | |
| JP | 3-31420 | A | | 2/1991 | |
| JP | 4-107215 | A | | 4/1992 | |
| JP | 4-136138 | A | | 5/1992 | |
| JP | 04136138 | A | * | 5/1992 | C22C 38/00 |
| JP | 6-192731 | A | | 7/1994 | |
| JP | 10-251751 | A | | 9/1998 | |
| JP | 11-61257 | A | | 3/1999 | |
| JP | 11-286725 | A | | 10/1999 | |
| JP | 11-315326 | A | | 11/1999 | |
| JP | 2001-164318 | A | | 6/2001 | |
| JP | 2002-3945 | A | | 1/2002 | |
| JP | 2002-115034 | A | | 4/2002 | |
| JP | 2002-356752 | A | | 12/2002 | |
| JP | 2002-363713 | A | | 12/2002 | |
| JP | 2006-241554 | A | | 9/2006 | |
| JP | 2007-217744 | A | | 8/2007 | |
| JP | 2009-102739 | A | | 5/2009 | |
| JP | 2010-24531 | A | | 2/2010 | |

OTHER PUBLICATIONS

International Search Report issued in PCT/JP2012/079066, mailed on Feb. 12, 2013.

PCT/ISA/237—Issued in PCT/JP2012/079066, mailed on Feb. 12, 2013.

International Preliminary Report on Patentability dated Mar. 13, 2014, issued in PCT/JP2012/079066 (Forms PCT/IB/308, PCT/IB/338, PCT/IB/373 and PCT/ISA/237).

Taiwanese Office Action dated Jun. 17, 2014, issued in corresponding Taiwanese Patent Application No. 101141794.

* cited by examiner

NON-ORIENTED ELECTRICAL STEEL SHEET AND MANUFACTURING METHOD THEREOF

TECHNICAL FIELD

The present invention relates to a non-oriented electrical steel sheet having α-γ transformation (ferrite-austenite transformation) and having an excellent magnetic property, and a manufacturing method thereof. This application is based upon and claims the benefit of priority of the prior Japanese Patent Application No. 2011-247637, filed on Nov. 11, 2011 and the prior Japanese Patent Application No. 2011-247683, filed on Nov. 11, 2011, the entire contents of which are incorporated herein by reference.

BACKGROUND ART

With a recent increase in requirement for achieving high efficiency of various electrical apparatuses, a non-oriented electrical steel sheet to be used as an iron core is required to achieve high magnetic flux density and achieve low core loss. A low-Si steel is advantageous for manufacturing a steel sheet having a particularly high magnetic flux density, which inevitably results in using a steel in a range of a chemical composition having α-γ transformation. In a low-Si non-oriented electrical steel sheet, there have been proposed many methods of improving a magnetic property.

For example, in Patent Literature 1, there has been proposed a method of finishing hot rolling at an Ar3 transformation point or higher and slowly cooling a temperature region of the Ar3 transformation point to an Ar1 transformation point at 5° C./sec or less. However, it is difficult to perform this cooling rate in hot rolling in an actual machine.

Further, in Patent Literature 2, there has been proposed a method of adding Sn to a steel and controlling a finishing temperature of hot rolling according to the concentration of Sn, thereby obtaining a high magnetic flux density. However, in this method, the concentration of Si is limited to 0.4% or less, which is not enough to obtain a low core loss.

Further, in Patent Literature 3, there has been proposed a steel sheet having a high magnetic flux density and having an excellent grain growth property at the time of stress relieving annealing by limiting a heating temperature and a finishing temperature at the time of hot rolling. This method does not include a process of self annealing or the like in place of hot rolling annealing, so that it has been impossible to obtain a high magnetic flux density.

Further, Patent Literature 4 has proposed to, in hot rolling, heat a rough bar before finish rolling on line, set a finishing temperature of the hot rolling to Ar1+20° C. or higher, and set a winding temperature to 640 to 750° C. However, this method aims to make precipitates harmless, resulting in that a high magnetic flux density has not been obtained.

CITATION LIST

Patent Literature

Patent Literature 1: Japanese Laid-open Patent Publication No. 6-192731

Patent Literature 2: Japanese Laid-open Patent Publication No. 2006-241554

Patent Literature 3: Japanese Laid-open Patent Publication No. 2007-217744

Patent Literature 4: Japanese Laid-open Patent Publication No. 11-61257

SUMMARY OF INVENTION

Technical Problem

An object of the present invention is to provide a non-oriented electrical steel sheet being a non-oriented electrical steel sheet having α-γ transformation, having a higher magnetic flux density, and having a low core loss, and a manufacturing method thereof.

Solution to Problem

The present invention is to optimize hot rolling conditions together with a chemical composition of a steel to thereby make a structure obtained after hot rolling annealing or a structure obtained after self annealing coarse and increase a magnetic flux density of a product obtained after cold rolling and finish annealing.

The present invention made as above is as follows.

(1) A non-oriented electrical steel sheet, contains:

in mass %,

C: 0.005% or less;

Si: 0.1% to 2.0%;

Mn: 0.05% to 0.6%;

P: 0.100% or less;

Al: 0.5% or less; and a balance being composed of Fe and inevitable impurities, in which 10 pieces/$\mu m^3$ or less in number density of non-magnetic precipitate AlN having an average diameter of 10 nm to 200 nm are contained, a structure is made of ferrite grains containing no non-recrystallized structure, and an average grain diameter of the ferrite grains is 30 μm to 200 μm, and an average magnetic flux density B50 in a rolling direction and in a direction perpendicular to rolling is 1.75 T or more.

(2) The non-oriented electrical steel sheet according to (1), further contains:

in mass %, at least one of Sn and Sb of 0.05% to 0.2%.

(3) The non-oriented electrical steel sheet according to (1) or (2), further contains:

in mass %, B of 0.0005% to 0.0030%.

(4) A manufacturing method of a non-oriented electrical steel sheet, includes:

on a slab having a steel composition containing, in mass %

C: 0.005% or less;

Si: 0.1% to 2.0%;

Mn: 0.005% to 0.6%;

P: 0.100% or less;

Al: 0.5% or less; and a balance being composed of Fe and inevitable impurities, performing hot rolling to obtain a hot-rolled steel sheet;

performing hot rolling annealing on the hot-rolled steel sheet to obtain a hot-rolled annealed steel sheet;

performing cold rolling on the hot-rolled annealed steel sheet to obtain a cold-rolled steel sheet; and performing finish annealing on the cold-rolled steel sheet, in which in the hot rolling, a heating temperature of the slab is set to 1050° C. to 1250° C., a finish rolling finishing temperature is set to 800° C. to (an Ar1 transformation point+20° C.), and a coil winding temperature is set to 500° C. to 700° C., and an annealing temperature in the hot rolling annealing is set to 750° C. to an Ac1 transformation point and an annealing temperature in the finish annealing is set to 800° C. to the Ac1 transformation point.

(5) The manufacturing method of the non-oriented electrical steel sheet according to (4), in which the slab further contains, in mass %, at least one of Sn and Sb of 0.05% to 0.2%.

(6) The manufacturing method of the non-oriented electrical steel sheet according to (4) or (5), in which the slab further contains, in mass %, B of 0.0005% to 0.0030%.

(7) A manufacturing method of a non-oriented electrical steel sheet, includes:

on a slab having a steel composition containing, in mass %,

C: 0.005% or less,

Si: 0.1% to 2.0%,

Mn: 0.05% to 0.6%,

P: 0.100% or less,

Al: 0.5% or less, and a balance being composed of Fe and inevitable impurities, performing hot rolling to obtain a hot-rolled steel sheet;

performing cold rolling on the hot-rolled steel sheet to obtain a cold-rolled steel sheet; and performing finish annealing on the cold-rolled steel sheet, in which in the hot rolling, a heating temperature of the slab is set to 1050° C. to 1250° C., a finish rolling finishing temperature is set to 800° C. to (an Ar1 transformation point+20° C.), and a coil winding temperature is set to 780° C. or higher, and an annealing temperature in the finish annealing is set to 800° C. to an Ac1 transformation point.

(8) The manufacturing method of the non-oriented electrical steel sheet according to (7), in which the slab further contains, in mass %, at least one of Sn and Sb of 0.05% to 0.2%.

(9) The manufacturing method of the non-oriented electrical steel sheet according to (7) or (8), in which the slab further contains, in mass %, B of 0.0005% to 0.0030%.

Here, B50 is a magnetic flux density when a magnetic filed of 50 Hz and 5000 A/m is applied.

Advantageous Effects of Invention

According to the present invention, it is possible to provide a non-oriented electrical steel sheet having a higher magnetic flux density and having a low core loss and a manufacturing method thereof.

DESCRIPTION OF EMBODIMENTS

There will be first described experimental results led to the present invention.

There were melted steel ingots each using a steel having a chemical composition containing, in mass %, C: 0.0011%, Si: 0.7%, Mn: 0.17%, P: 0.073%, Al: 0.31%, and Sn: 0.095%, and a balance being composed of Fe and inevitable impurities, in a laboratory manner. In a Formaster test, it was confirmed that of this steel, an Ar1 transformation point is 963° C., an Ar3 transformation point is 1020° C., and an Ac1 transformation point is 1060° C.

Next, the steel ingots were heated at a temperature of 1150° C. for 1 hour to be subjected to hot rolling. At this time, a finish rolling finishing temperature FT was changed in a range of 880° C. to 1080° C. Incidentally, each finished thickness was 2.5 mm.

Next, on each of obtained hot-rolled steel sheets, hot rolling annealing at a temperature of 850° C. for a maintaining time period of 1 to 120 minutes was performed, or hot rolling annealing was not performed, and the steel sheets were each pickled and cold rolled to 0.5 mm in thickness of the steel sheet, and further were each subjected to finish annealing at 900° C. for 30 seconds.

Figure 1:
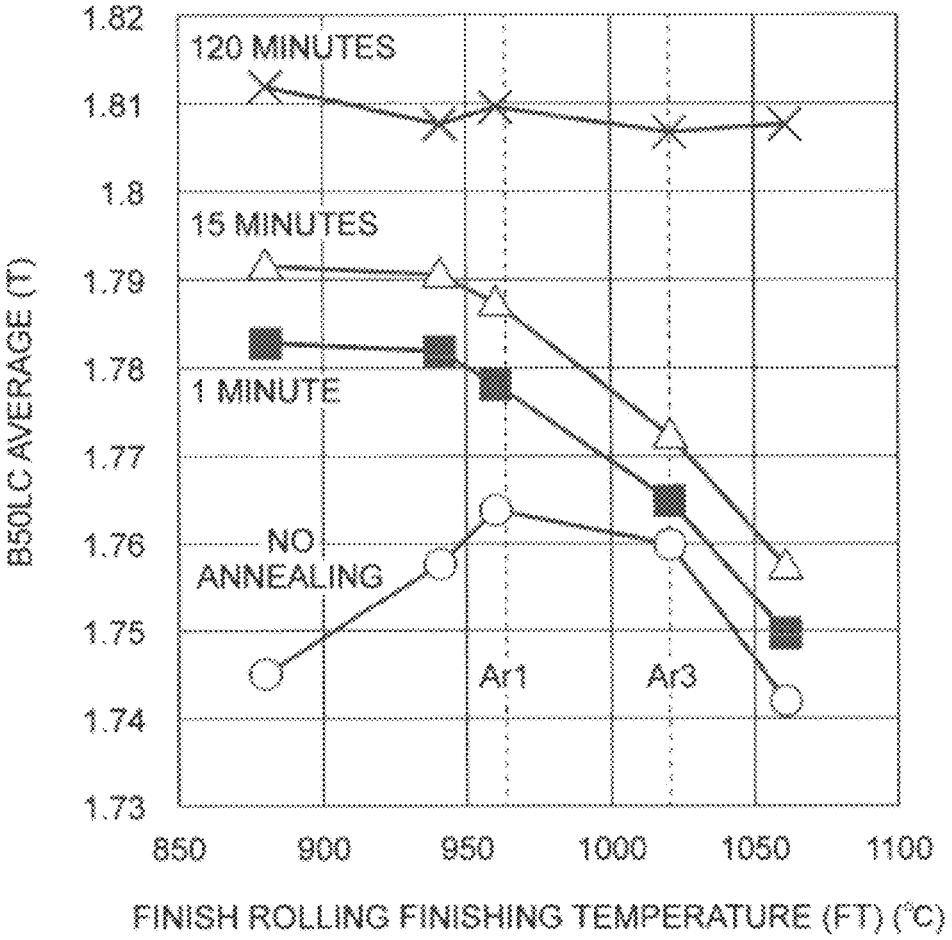
FIG. 1 is a view showing changes in relationship between a finishing temperature FT of hot rolling and an average magnetic flux density B50 in the case when a maintaining time period of hot rolling annealing is changed.
Figure 2:
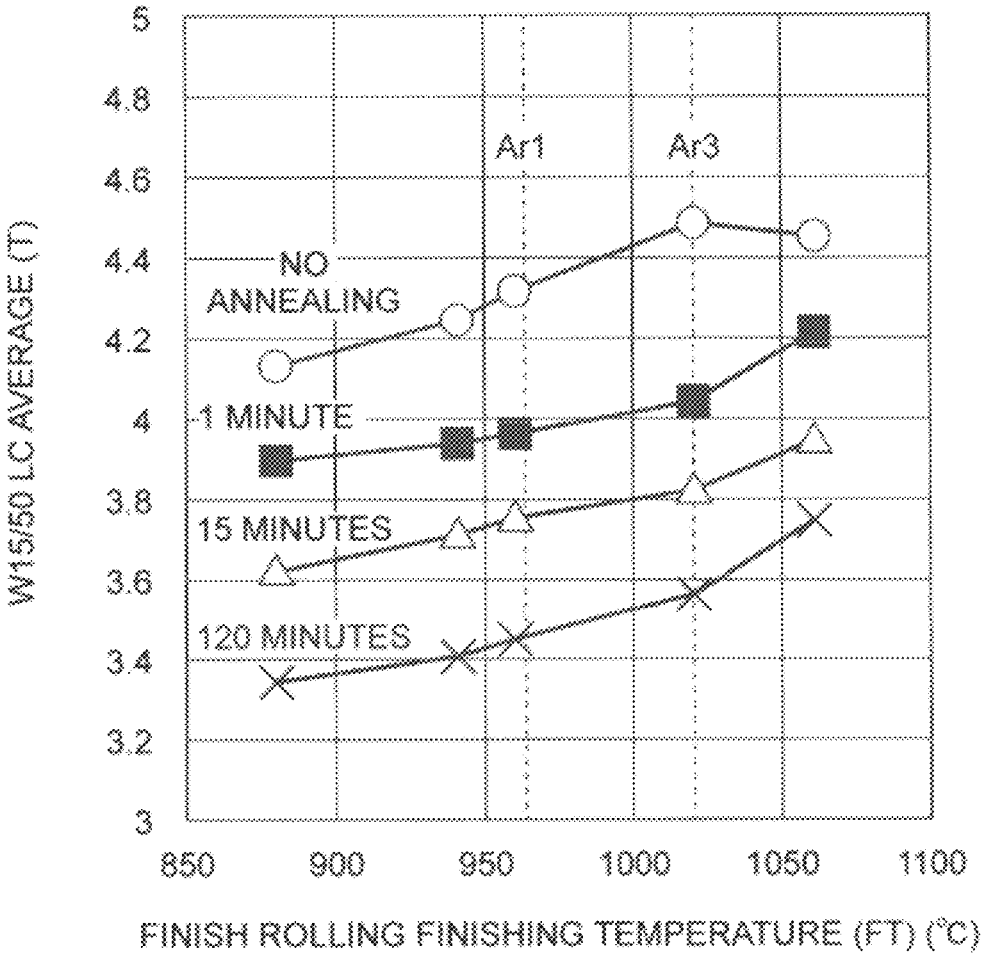
FIG. 2 is a view showing changes in relationship between a finishing temperature FT of the hot rolling and a core loss W15/50 in the case when the maintaining time period of the hot rolling annealing is changed.

Then, from each of obtained finish-annealed steel sheets, a test piece having a size of 55 mm×55 mm was cut out to be magnetically measured in a rolling direction (an L direction) and in a direction perpendicular to the rolling direction (a C direction) by an exciting current method determined in JIS C 2556. FIG. 1 shows the relationship between the finish rolling finishing temperature FT and an average magnetic flux density B50 in the L·C directions in the case when the maintaining time period of the hot rolling annealing is changed. Incidentally, FIG. 2 shows the relationship between the finish rolling finishing temperature FT and a core loss W15/90 in the case when the maintaining time period of the hot rolling annealing is changed.

On the condition of the hot rolling annealing not being performed, the average magnetic flux density B50 is highest when the finish rolling finishing temperature FT is around the Ar1 transformation point. On the condition of the maintaining time period being 1 minute, when the finish rolling finishing temperature FT is the Ar1 transformation point or lower, the average magnetic flux density B50 of a material increases rapidly, and as the finish rolling finishing temperature FT is lower, the average magnetic flux density B50 becomes higher. Even on the condition of the maintaining time period being 15 minutes, a similar tendency is shown and the average magnetic flux density B50 reaches 1.79 T. On the condition of the steel sheet being maintained for 120 minutes, when the finish rolling finishing temperature FT is the Ar1 transformation point or higher, the average magnetic flux density of B50 of a material increases rapidly to be about 1.81 T regardless of the finish rolling finishing temperature FT.

Figure 3:
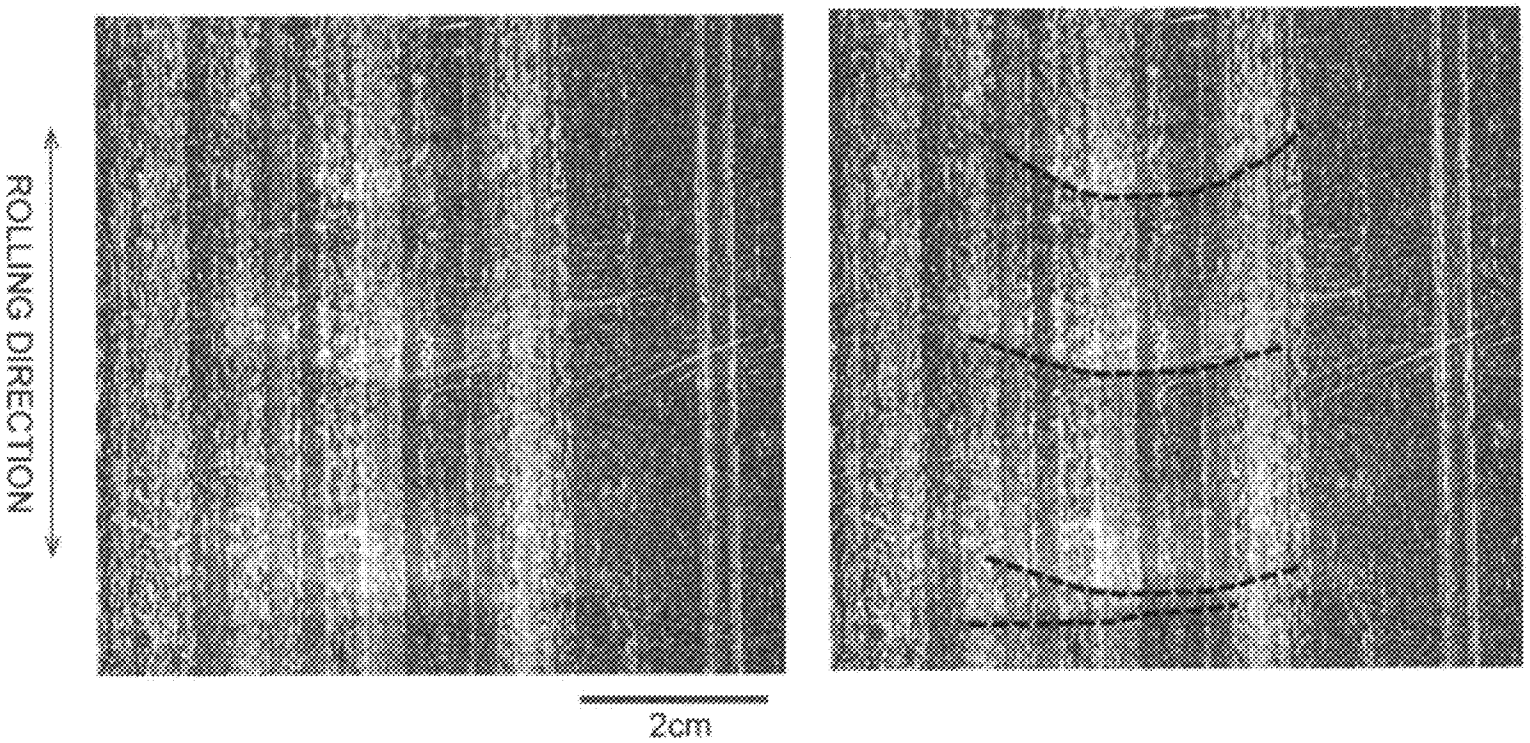
FIG. 3 is photographs showing one example of breaks observed in a steel sheet obtained by performing cold rolling and then finish annealing on a material treated at the finishing temperature FT of the hot rolling of 1060° C. and under a hot rolling annealing condition of 850° C.×120 minutes.

On the other hand, however, in the finish-annealed steel sheet obtained by being subjected to cold rolling and then finish annealing when the finish rolling finishing temperature FT was set to 1060° C. and the hot rolling annealing condition was set to the annealing temperature of 850° C. and the maintaining time period of 120 minutes, plural breaks shown in FIG. 3, extending in the direction perpendicular to rolling, and penetrating in a sheet thickness direction were observed. Incidentally, in the same drawing, break portions are shown by a dotted line.

Occurrence of such breaks in an actual product leads to a decrease in space factor. In Table 1, conditions causing breaks to be observed are shown, but such a phenomenon of breaks is observed when the finish rolling finishing temperature FT is high and the maintaining time period of the hot rolling annealing is long.

TABLE 1

BREAK IN STEEL SHEET AFTER FINISH ANNEALING (○: NONE, X: EXISTENCE)

| HOT ROLLING ANNEALING | FINISH ROLLING FINISHING TEMPERATURE FT | | | | |
|---|---|---|---|---|---|
| CONDITION | 880° C. | 940° C. | 960° C. | 1020° C. | 1060° C. |
| NO ANNEALING | ○ | ○ | ○ | ○ | ○ |
| 850° C. × 1 MINUTE | ○ | ○ | ○ | ○ | ○ |
| 850° C. × 15 MINUTES | ○ | ○ | ○ | ○ | ○ |
| 850° C. × 120 MINUTES | ○ | ○ | ○ | X | X |

Figure 4:
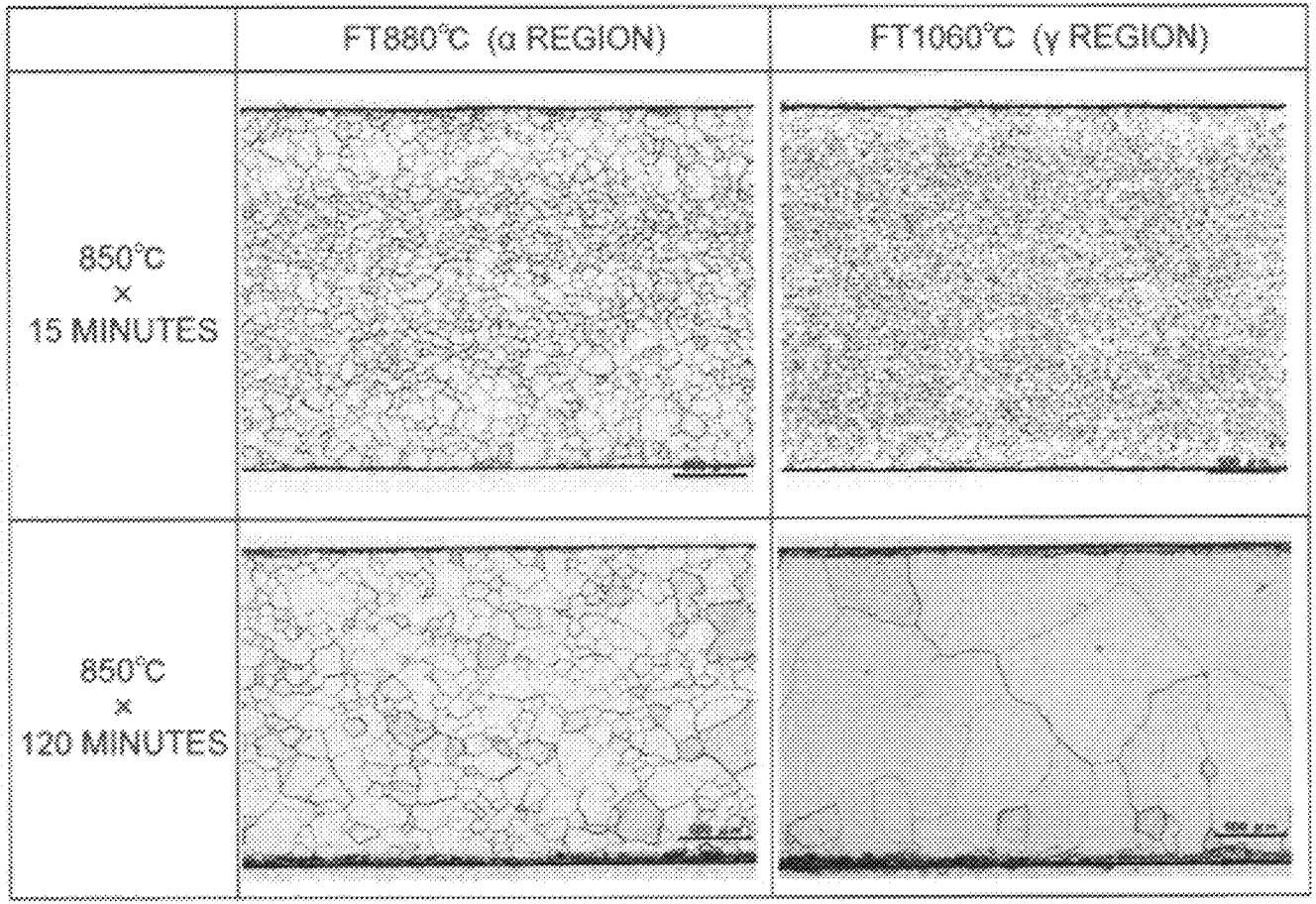
FIG. 4 is photographs each showing a metal structure of a cross section obtained after hot rolling annealing.

Next, in order to explore the cause of the occurrence of breaks, there were examined structures of hot-rolled annealed steel sheets obtained by performing the hot rolling annealing on the hot-rolled steel sheets each having the different finish rolling finishing temperature FT under different conditions. FIG. 4 shows cross-sectional structures obtained after the hot rolling annealing.

It is found in the hot-rolled annealed steel sheet having the finish rolling finishing temperature FT of 880° C. (α region) that grains grow uniformly with the maintaining time period. On the other hand, in the case of the finish rolling finishing temperature FT of 1060° C. (γ region), the structure is fine when the maintaining time period is 15 minutes, but when the maintaining time period is 120 minutes, the structure grows rapidly. Therefore, as for the breaks seen in the finish-annealed steel sheet, it is conceivable that because of the structure before cold rolling being too large, breaks occurred in the steel sheet obtained after cold rolling and recrystallization.

Figure 5:
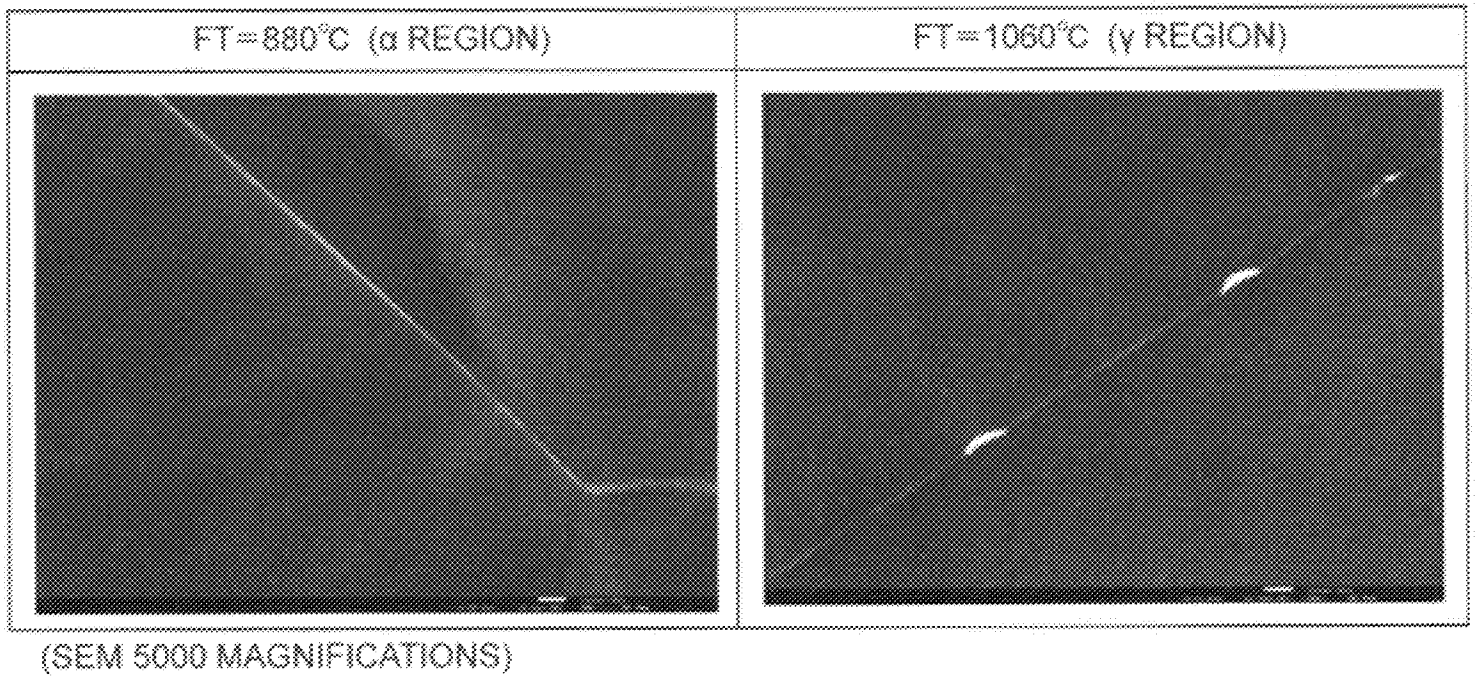
FIG. 5 is photographs showing an observation result of fine precipitates (SEM 50000 magnifications).

Further, in order to explore the cause of such a structure change after the hot rolling annealing, there were observed fine structures of the hot-rolled steel sheets obtained immediately after the hot rolling having the finish rolling finishing temperatures FT of 880° C. and 1060° C. by using a SEM (Scanning Electron Microscope). FIG. 5 shows results of the fine structure observation. In the case of the finish rolling finishing temperature FT being 1060° C., fine precipitates were observed at a grain boundary and this fine precipitate was confirmed to be AlN. As for this fine AlN, it is presumed that when the maintaining time period of the annealing is short, grain growth is suppressed, but when the maintaining time period is prolonged, the structure is subjected to ripening and pinning of grain boundaries is released and thus abnormal grain growth occurs. On the other hand, in the case of the finish rolling finishing temperature FT being 880° C. no fine precipitates at a grain boundary were observed. Thus, in this case, grains grow normally. A mechanism causing the difference in precipitation of AlN is not clear but is conceived as follows.

AlN precipitates in large amounts when a parent phase is transformed to an α phase from a γ phase because its solubility becomes smaller in the α phase than in the γ phase. Or the other hand, when grains in the γ phase are worked, the structure in the γ phase before transformation contains a non-recrystallized structure according to circumstances, and even if the structure is recrystallized, a grain diameter of the worked grains is smaller than that of the γ phase before reduction. Then, when the parent phase is transformed, α nuclei are created by using grain boundaries of the prior γ phase as precipitation sites to be a fine α phase structure. Simultaneously with the transformation, AlN becomes likely to precipitate, so that grain boundaries of grains in the α phase become precipitation sites and AlN finely precipitates in large amounts.

From the above-described experiment, it was found that in order to obtain an excellent magnetic property in the steel with the chemical composition having the α-γ transformation, performing annealing on a hot-rolled steel sheet is important, but in order to prevent abnormal grain growth to cause breaks in the steel sheet obtained after finish annealing after cold rolling from being caused, it is necessary to lower the finish rolling finishing temperature of hot rolling from the vicinity of Ar1.

The present invention has been made based on such examination results, and hereinafter, there will be sequentially described requirements of a non-oriented electrical steel sheet and a manufacturing method thereof that are prescribed in the present invention in detail.

First, there will be explained reasons for limiting a chemical composition of a steel to be used for the non-oriented electrical steel sheet of the present invention. In the following, % of each content means mass %.

<C: 0.005% or Less>

C is a harmful element that deteriorates a core loss and also causes magnetic aging, to thus be set to 0.005% or less. It is preferably 0.003% or less. It also includes 0%.

<Si: 0.1% to 2.0%>

Si is an element that increases resistivity of the steel and decreases a core loss, and its lower limit is set to 0.1%. Its excessive addition decreases a magnetic flux density. Thus, the upper limit of Si is set to 2.0%. Si is preferably 0.1% to 1.6%.

<Mn: 0.05% to 0.6%>

Mn increases resistivity of the steel and coarsens sulfide to make it harmless. However, its excessive addition leads to embrittlement of the steel and an increase in cost. Thus, Mn is set to 0.05% to 0.6%. It is preferably 0.1% to 0.5%.

<P: 0.100% or Less>

P is added in order to secure hardness of the steel sheet obtained after recrystallization. Its excessive addition causes embrittlement of the steel. Thus, P is set to 0.100% or less. It is preferably 0.001% to 0.08%.

<Al: 0.5% or Less>

Al is likely to bond to N to form AlN. Applying a hot rolling method to be described later makes it possible to prevent its fine precipitation, but if Al is too large in amount, AlN tends to precipitate finely in spite of using the hot rolling method. Thus, Al is set to 0.5% or less. On the other hand, Al is also an element effective for deoxidation. It is preferably 0.03% to 0.4%.

<At Least One of Sn and Sb: 0.05% to 0.2%>

Sn and Sb improve a texture obtained after cold rolling and recrystallization to improve its magnetic flux density, to thus be added according to need. However, their/its excessive addition embrittles the steel. Therefore, when being added, Sn and/or Sb are/is preferably set to 0.05% to 0.2%. They/It are/is preferably 0.05% to 0.15%.

<B: 0.005% to 0.0030%>

B forms BN, fixes N in priority to Al, and has a function of suppressing fine precipitation of AlN when the steel sheet is transformed to the α phase from the γ phase, to thus be added according to need. However, when being added excessively, B is solid-dissolved to deteriorate the texture and decrease the magnetic flux density. Therefore, when being added, B is preferably set to 0.0005% to 0.0030%. It is preferably 0.001% to 0.002%.

<N>

As has been described previously, in the present invention, the fine precipitation of AlN is suppressed to thereby obtain an excellent magnetic property. A nitrogen content set as a premise is in a normal range and is not prescribed in particular, but as long as the present invention is used even though the content is 40 ppm, for example, a good magnetic property can be obtained. N is preferably set to 30 ppm or less, and is more preferably set to 20 ppm or less, thereby making it possible to obtain a better magnetic property.

The non-oriented electrical steel sheet of the present invention has the α-γ transformation-based steel composition as described above and the balance of the composition is Fe and inevitable impurities.

Subsequently, there will be explained other characteristics of the non-oriented electrical steel sheet of the present invention.

In the present invention, the number density of non-magnetic precipitate AlN having an average diameter of 10 nm to 200 nm in the steel sheet is suppressed to be 10 pieces/$\mu m^3$ or less.

As a result of the observation described above, in the present invention, the average diameter of AlN that most affects the grain growth at the time of hot rolling annealing and at the time of finish annealing was 10 nm to 200 nm. Thus, the number density of AlN in this size is prescribed. When the number density exceeds 10 pieces/$\mu m^3$, the grain growth in recrystallization of the hot-rolled steel sheet is not sufficient at the time of hot rolling annealing to lead to a decrease in magnetic flux density. Further, the grain growth in recrystallization at the time of finish annealing after cold rolling is also adversely affected. The number density is preferably 5 pieces/$\mu m^3$ or less.

Further, the structure of the non-oriented electrical steel sheet of the present invention is a structure made of ferrite grains containing no non-recrystallized structure, and an average grain diameter of the ferrite grains is made to 30 μm to 200 μm. When a non-recrystallized structure is contained, or even if the structure is recrystallized completely, if the average grain diameter is less than 30 μm, a hysteresis loss increases, resulting in that the total core loss increases. It is preferably 40 μm or more, and is further preferably 60 μm or more. Further, when the average grain diameter of the ferrite grains exceeds 200 μm, an eddy current loss increases, resulting in that the total core loss increases. It is preferably 150 μm or less.

In the non-oriented electrical steel sheet constituted as above, the average magnetic flux density B50 in the rolling direction and in the direction perpendicular to rolling is 1.75 T or more. Further, as has been explained previously, Sn and Sb have a function of improving the texture obtained after cold rolling and recrystallization to improve the average magnetic flux density B50.

Next, there will be explained the manufacturing method for obtaining the non-oriented electrical steel sheet of the present invention.

As for the manufacturing method of the present invention, on a slab having the steel composition described above, hot rolling is performed, and on an obtained hot-rolled steel sheet, annealing is performed, cold rolling is performed after pickling, and then finish annealing is performed, but as for the annealing on the hot-rolled steel sheet, not only a method of heating a coil externally such as continuous annealing or batch annealing, but also a method of performing self annealing by using heat at the time of hot rolling is possible.

Regardless of the method of hot rolling annealing, the temperature at which the slab is heated in the hot rolling is set to 1250° C. or lower in order to prevent re-solid-dissolution-fine precipitation of an impurity such as sulfide and so as not to make the core loss deteriorate. However, when the heating temperature is too low, a decrease in ability is set to 1050° C. or higher. It is preferably 1100° C. to 1200° C.

Rough rolling and descaling of the hot rolling to be performed subsequently only need to be performed by normal methods and conditions are not limited in particular.

Hereinafter, the annealing of the hot-rolled steel sheet will be explained separately by using the case where the annealing of the hot-rolled steel sheet is performed by external heating and the case where the annealing of the hot-rolled steel sheet is performed by self annealing.

The first is the case of the method of external heating. In finish rolling of the hot rolling, the finishing temperature FT is set to 800° C. to (the Ar1 transformation point+20° C.). When the finish rolling finishing temperature FT is set to lower than 800° C., the operation of the hot rolling becomes unstable and productivity decreases. On the other hand, when the finish rolling finishing temperature Ft is set to higher than the Ar1 transformation point+20° C., AlN finely precipitates in large amounts at grain boundaries of α grains obtained after transformation and thereby grain growth of ferrite grains in a hot-rolled annealed steel sheet is inhibited. As has been further explained previously, depending on the combination with the hot rolling annealing condition, breaks occur in the steel sheet obtained after cold rolling and recrystallization. The finish rolling finishing temperature FT is preferably in a range of 800° C. to the Ar1 transformation point.

A coil winding temperature is set to 500 to 700° C. When it is lower than 500° C., the operation of the hot rolling becomes unstable. When it is 700° C. or higher, a lot of scales are adsorbed to the surface of the steel sheet, resulting in that it becomes difficult to remove the scales by pickling.

As for the hot rolling annealing to be performed next, when the temperature is too low, the increase in the average magnetic flux density B50 is not sufficient, and when the temperature is too high, transformation is caused and the structure obtained after the annealing becomes fine. Thus, the temperature is set to be in a temperature range of 750° C. to the Ac1 transformation point. The maintaining time period can be selected appropriately. As for the method, not only continuous annealing, but also box annealing is possible.

Thereafter, the hot-rolled annealed steel sheet is cold-rolled after pickling, and a cold-rolled steel sheet is obtained and then is finish annealed. In a finish annealing process, the structure obtained after the annealing is made into a ferrite phase containing no non-recrystallized structure and an average grain diameter of ferrite grains of the ferrite phase is made to 30 μm to 200 μm. In order to make the average grain diameter of the ferrite grains to 30 μm or more, the annealing temperature is set to 800° C. or higher. However, when it exceeds the Ac1 transformation point, the structure is grain-refined, so that it is set to the Ac1 transformation point or lower. It is preferably 850° C. to the Ac1 transformation point.

Next, there will be explained the case of the self annealing using heat at the time of hot rolling. The finish rolling finishing temperature FT of the hot rolling is set to 800° C. to (the Ar1 transformation point+20° C.) similarly to the previous case of the method of external heating. When the hot rolling is operated at the Ar1 transformation point+20° C. or higher, in the subsequent self annealing, grain growth of ferrite grains is inhibited, and thus the above setting is to avoid it. Further, the lower limit is set to 800° C. for stabilization of the operation of the hot rolling, but it is preferably higher in order to increase the temperature of the self annealing after winding. The finish rolling finishing temperature Ft is preferably 850° C. to the Ar1 transformation point+20° C.

For the self annealing in which a coil itself is annealed by heat of hot rolling, the coil winding temperature is set to 780° C. or higher. When the coil is water-cooled for the reason of improving a descaling property or the like, the time to start of the water cooling is set to 10 minutes or longer. The structure formed by the hot rolling becomes coarse by these operations and the magnetic flux density improves. Further, the precipitates also become coarse and the grain growth at the time of finish annealing after cold rolling is improved. The winding temperature, as the temperature is higher, the structure becomes larger by the self annealing, is thus preferably 800° C. or higher, and is further preferably 850° C. or higher.

A rough bar may also be heated immediately before the finish rolling in order to increase the winding temperature. Further, depending on the steel component, the Ar1 transformation point is low, so that by the previous limiting of the finishing temperature, the subsequent winding temperature also sometimes decreases. In the case, it is possible to heat the hot-rolled steel sheet immediately before winding to thereby increase the temperature to a temperature lower than the Ac1 transformation point. These heating methods are not limited in particular, but it is possible to use induction heating or the like.

Further, the upper limit of the winding temperature is preferably set to the Ac1 transformation point or lower. When the winding temperature becomes higher than the Ac1 transformation point, the structure is transformed again in a cooling process and the structure before cold rolling becomes fine, resulting in that the magnetic flux density after cold rolling and recrystallization decreases.

A self-annealed steel sheet manufactured in the above-described processes is cold rolled after pickling, and thereby a cold-rolled steel sheet is obtained and then is finish annealed. In a finish annealing process, the structure obtained after the annealing is made into a ferrite phase containing no non-recrystallized structure and an average grain diameter of ferrite grains of the ferrite phase is made to 30 μm to 200 μm. In order to make the average grain diameter of the ferrite grains to 30 μm or more, the annealing temperature is set to 800° C. or higher. However, when it exceeds the Ac1 transformation point, the structure is grain-refined, so that it is set to the Ac1 transformation point or lower. It is preferably 850° C. to the Ac1 transformation point.

The present invention is the non-oriented electrical steel sheet having a high magnetic flux density and having a low core loss and the manufacturing method of the electrical steel sheet as above, and hereinafter, there will be further explained the applicability and effects of such a present invention by using examples. Incidentally, conditions and so on in experiments to be explained below are example employed for confirming the applicability and effects of the present invention and the present invention is not limited to these examples.

EXAMPLE

Example 1

Ingots having chemical compositions shown in Table 2 were vacuum-melted to be manufactured in a laboratory, and next these ingots were heated and rough rolled, and thereby rough bars each having a thickness of 40 mm were obtained. On the obtained rough bars, hot finish rolling was performed, and thereby hot-rolled steel sheets each having a thickness of 2.5 mm were made, and after hot rolling annealing at 850° C. for 15 minutes, pickling was performed, cold rolling was performed to 0.5 mm, and finish annealing was performed. In the same table, transformation temperatures of each steel, a hot rolling heating temperature, a finish rolling temperature, a winding equivalent temperature, and a finish annealing temperature after cold rolling are shown.

Next, magnetic property evaluation of each of obtained samples was performed by the Epstein method (JIS C 2556), and grain diameter measurement (JIS G 0552) and precipitate observation were also performed. These results are also shown in the same table. The magnetic property (magnetic flux density) was shown in an average value in the L direction and the C direction. In the evaluation this time, ones each having the average magnetic flux density B50 of 1.75 T or more and the core loss W15/50 of 5.0 W/kg or less were evaluated to be good, and in all present invention examples, good properties were obtained.

As shown in Table 2, in non-oriented electrical steel sheets each having the chemical composition falling within the range of the present invention, an excellent magnetic property was obtained. On the other hand, of comparative examples, B3 had the low average magnetic flux density B50, B6 had fracture generated in the steel sheet, and the others had a large core loss.

TABLE 2

| | STEEL | STEEL COMPOSITION (MASS %) | | | | | | | Ar1 | Ac1 | HEATING TEMPERATURE | FINISH ROLLING TEMPERATURE | | WINDING TEMPERATURE |
|---|---|---|---|---|---|---|---|---|---|---|---|---|---|---|
| | No. | C | Si | Mn | P | Al | Sn | Sb | (° C.) | (° C.) | (° C.) | (° C.) | (° C.) | (° C.) |
| EXAMPLE | A1 | 0.003 | 0.2 | 0.2 | 0.04 | 0.5 | — | — | 990 | 1050 | 1250 | 1000 | Ar1 + 10 | 650 |
| | A2 | 0.003 | 1.6 | 0.2 | 0.01 | 0.005 | — | — | 1040 | 1100 | 1250 | 1010 | Ar1 − 30 | 650 |

TABLE 2-continued

| | | | | | | | | | | | | | | |
|---|---|---|---|---|---|---|---|---|---|---|---|---|---|---|
| | A3 | 0.003 | 0.5 | 0.1 | 0.04 | 0.03 | — | — | 890 | 950 | 1150 | 910 | Ar1 + 20 | 650 |
| | A4 | 0.004 | 0.5 | 0.5 | 0.04 | 0.3 | — | — | 920 | 980 | 1150 | 940 | Ar1 + 20 | 650 |
| | A5 | 0.002 | 0.5 | 0.2 | 0.04 | 0.5 | — | — | 1030 | 1100 | 1250 | 1000 | Ar1 − 30 | 650 |
| | A6 | 0.003 | 0.5 | 0.2 | 0.1 | 0.3 | — | — | 940 | 1010 | 1150 | 940 | Ar1 + 0 | 650 |
| | A7 | 0.002 | 0.5 | 0.2 | 0.08 | 0.03 | 0.06 | — | 880 | 955 | 1150 | 890 | Ar1 + 10 | 650 |
| | A8 | 0.003 | 0.5 | 0.2 | 0.08 | 0.3 | 0.1 | — | 955 | 1020 | 1150 | 960 | Ar1 + 5 | 650 |
| | A9 | 0.003 | 0.7 | 0.2 | 0.08 | 0.3 | 0.1 | — | 960 | 1060 | 1150 | 960 | Ar1 + 0 | 650 |
| | A10 | 0.003 | 1.1 | 0.2 | 0.01 | 0.3 | 0.15 | — | 1030 | 1120 | 1250 | 1000 | Ar1 − 30 | 650 |
| | A11 | 0.005 | 0.5 | 0.2 | 0.05 | 0.3 | — | 0.06 | 935 | 1000 | 1150 | 920 | Ar1 − 15 | 650 |
| COMPARATIVE EXAMPLE | B1 | 0.01 | 0.5 | 0.2 | 0.07 | 0.3 | — | — | 955 | 1020 | 1150 | 960 | Ar1 + 5 | 650 |
| | B2 | 0.003 | 0.08 | 0.2 | 0.005 | 0.3 | — | — | 890 | 940 | 1150 | 890 | Ar1 + 0 | 650 |
| | B3 | 0.003 | 2.1 | 0.2 | 0.005 | 0.3 | — | — | — | — | 1150 | 950 | — | 650 |
| | B4 | 0.005 | 0.5 | 0.01 | 0.07 | 0.3 | — | — | 960 | 1020 | 1150 | 960 | Ar1 + 0 | 650 |
| | B5 | 0.003 | 0.5 | 0.8 | 0.005 | 0.3 | — | — | 890 | 930 | 1150 | 890 | Ar1 + 10 | 650 |
| | B6 | 0.004 | 0.5 | 0.2 | 0.2 | 0.3 | — | — | 960 | 1030 | 1150 | 960 | Ar1 + 0 | 650 |
| | B7 | 0.005 | 0.5 | 0.2 | 0.08 | 0.7 | — | — | 1060 | 1130 | 1250 | 1000 | Ar1 − 40 | 650 |

| | | HOT-ROLLED SHEET ANNEALING | | FINISH ANNEALING TEMPERATURE | AIN NUMBER | NON- | FERRITE GRAIN | | W15/ |
|---|---|---|---|---|---|---|---|---|---|
| | STEEL No. | TEMPERATURE (c.) | TIME MINUTE | AFTER COLD ROLLING (° C.) | DENSITY (PIECE/ $\mu m^3$) | RECRYSTALIZIED STRUCTURE | DIAMETER (μm) | B50 (T) | 50 (W/kg) |
| EXAMPLE | A1 | 950 | 1 | 850 | 7 | NOT CONTAINED | 52 | 1.777 | 4.3 |
| | A2 | 950 | 1 | 950 | 5 | NOT CONTAINED | 79 | 1.765 | 2.9 |
| | A3 | 950 | 1 | 900 | 2 | NOT CONTAINED | 59 | 1.781 | 4.0 |
| | A4 | 950 | 1 | 900 | 3 | NOT CONTAINED | 79 | 1.775 | 3.7 |
| | A5 | 950 | 1 | 1000 | 8 | NOT CONTAINED | 147 | 1.763 | 3.1 |
| | A6 | 950 | 1 | 900 | 3 | NOT CONTAINED | 66 | 1.776 | 4.1 |
| | A7 | 950 | 1 | 900 | 2 | NOT CONTAINED | 61 | 1.817 | 4.0 |
| | A8 | 950 | 1 | 900 | 2 | NOT CONTAINED | 67 | 1.807 | 3.8 |
| | A9 | 950 | 1 | 900 | 2 | NOT CONTAINED | 69 | 1.800 | 3.5 |
| | A10 | 950 | 1 | 900 | 6 | NOT CONTAINED | 64 | 1.794 | 3.2 |
| | A11 | 950 | 1 | 900 | 2 | NOT CONTAINED | 62 | 1.804 | 3.9 |
| COMPARATIVE EXAMPLE | B1 | 950 | 1 | 900 | 8 | NOT CONTAINED | 66 | 1.760 | 4.9 |
| | B2 | 950 | 1 | 900 | 7 | NOT CONTAINED | 56 | 1.755 | 6.1 |
| | B3 | 950 | 1 | 950 | 2 | NOT CONTAINED | 77 | 1.712 | 3.0 |
| | B4 | 950 | 1 | 900 | 4 | NOT CONTAINED | 28 | 1.755 | 5.3 |
| | B5 | 900 | 1 | 850 | 7 | NOT CONTAINED | 25 | 1.744 | 6.0 |
| | B6 | 950 | 1 | COLD ROLLING FRACTURE | — | — | — | — | — |
| | B7 | 950 | 1 | 900 | 25 | NOT CONTAINED | 26 | 1.750 | 5.3 |

Example 2

Ingots each made of steel having a chemical composition containing, in mass %, C: 0.0014%, Si: 0.5%, Mn: 0.2%, P: 0.076%, Al: 0.3%, Sn: 0.09%, and a balance being composed of Fe and inevitable impurities were melted in a vacuum melting furnace in a laboratory. Of this steel, the Ar1 transformation point is 955° C., the Ar3 transformation point is 985° C., and the Ac1 transformation point is 1018° C.

These ingots were used, and under conditions shown in Table 3, hot rolling and hot rolling annealing were performed, and after pickling, cold rolling was performed to 0.5 mm and then under a condition shown in the same table, finish annealing was performed.

On each of obtained materials, magnetic measurement, grain diameter measurement, and precipitate portion observation were performed, similarly to Example 1. Manufacturing conditions and measurement results are together shown in Table 3. In these examples each having had Sn added thereto, when manufacturing was performed under the manufacturing conditions of the present invention, good properties of the average magnetic flux density B50 of 1.77 T or more and the core loss W15/50 of 4.5 W/kg or less were obtained.

In non-oriented electrical steel sheets manufactured by the manufacturing method falling within the range of the present invention, an excellent magnetic property was obtained. On the other hand, D2, D3, and D5 were each treated at a temperature at which the operation of hot rolling becomes unstable, so that in the experiment this time, reproducibility was not able to be confirmed even though the non-oriented electrical steel sheets each having an excellent magnetic property were obtained. Further, D4 had an excellent magnetic property, but scales attached to the surface of the steel sheet were not able to be removed sufficiently by the pickling and the shape of the steel sheet abnormally deteriorated by the cold rolling, so that D4 was not able to be handled as a product.

TABLE 3

| No. | SLAB HEATING TEMPERATURE (° C.) | FINISH ROLLING FINISHING TEMPERATURE (° C.) | WINDING TEMPERATURE (° C.) | HOT-ROLLED SHEET ANNEALING TEMPERATURE (c.) | HOT-ROLLED SHEET ANNEALING TIME (MINUTE) | FINISH ANNEALING TEMPERATURE AFTER COLD ROLLING (° C.) | AIN NUMBER DENSITY (PIECE/μm3) |
|---|---|---|---|---|---|---|---|
| C1 | 1250 | 960 | 650 | 850 | 60 | 900 | 7 |
| C2 | 1070 | 900 | 650 | 850 | 60 | 900 | 1 |
| C3 | 1150 | 1010 | 650 | 850 | 60 | 900 | 8 |
| C4 | 1150 | 830 | 650 | 850 | 60 | 900 | 2 |
| C5 | 1150 | 900 | 700 | 850 | 60 | 900 | 4 |
| C6 | 1150 | 900 | 510 | 850 | 60 | 900 | 1 |
| C7 | 1150 | 900 | 650 | 1000 | 1 | 900 | 2 |
| C8 | 1150 | 900 | 650 | 750 | 60 | 900 | 1 |
| C9 | 1150 | 900 | 650 | 850 | 60 | 1000 | 2 |
| C10 | 1150 | 900 | 650 | 850 | 60 | 800 | 1 |
| C11 | 1150 | 900 | 650 | 850 | 15 | 900 | 2 |
| C12 | 1150 | 900 | 650 | 850 | 60 | 900 | 1 |
| C13 | 1150 | 900 | 650 | 950 | 1 | 900 | 1 |
| D1 | 1280 | 1060 | 650 | 850 | 60 | 900 | 32 |
| D2 | 1030 | 790 | 650 | 850 | 60 | 900 | 1 |
| D3 | 1150 | 750 | 650 | 850 | 60 | 900 | 2 |
| D4 | 1150 | 900 | 750 | 850 | 60 | 900 | 6 |
| D5 | 1150 | 900 | 450 | 850 | 60 | 900 | 2 |
| D6 | 1150 | 900 | 650 | 1020 | 1 | 900 | 18 |
| D7 | 1150 | 900 | 650 | 650 | 60 | 900 | 3 |
| D8 | 1150 | 900 | 850 | 850 | 60 | 1050 | 22 |
| D9 | 1150 | 900 | 850 | 850 | 60 | 750 | 4 |

| No. | NON-RECRYSTALIZED STRUCTURE | FERRITE GRAIN DIAMETER (μm) | B50 (T) | W15/50 (W/kg) | BREAK IN STEEL SHEET AFTER FINISH ANNEALING | NOTE |
|---|---|---|---|---|---|---|
| C1 | NOT CONTAINED | 42 | 1.704 | 4.2 | NONE | EXAMPLE |
| C2 | NOT CONTAINED | 91 | 1.803 | 3.8 | NONE | EXAMPLE |
| C3 | NOT CONTAINED | 49 | 1.792 | 4.1 | NONE | EXAMPLE |
| C4 | NOT CONTAINED | 65 | 1.797 | 3.8 | NONE | EXAMPLE |
| C5 | NOT CONTAINED | 67 | 1.799 | 3.5 | NONE | EXAMPLE |
| C6 | NOT CONTAINED | 70 | 1.800 | 3.6 | NONE | EXAMPLE |
| C7 | NOT CONTAINED | 68 | 1.812 | 3.7 | NONE | EXAMPLE |
| C8 | NOT CONTAINED | 59 | 1.791 | 4.0 | NONE | EXAMPLE |
| C9 | NOT CONTAINED | 187 | 1.803 | 3.5 | NONE | EXAMPLE |
| C10 | NOT CONTAINED | 35 | 1.797 | 4.8 | NONE | EXAMPLE |
| C11 | NOT CONTAINED | 63 | 1.801 | 4.0 | NONE | EXAMPLE |
| C12 | NOT CONTAINED | 82 | 1.812 | 3.5 | NONE | EXAMPLE |
| C13 | NOT CONTAINED | 78 | 1.809 | 3.8 | NONE | EXAMPLE |
| D1 | NOT CONTAINED | 37 | 1.768 | 5.2 | EXISTENCE | COMPARATIVE EXAMPLE |
| D2 | NOT CONTAINED | 72 | 1.774 | 3.8 | NONE | REFERENCE EXAMPLE |
| D3 | NOT CONTAINED | 68 | 1.778 | 4.2 | NONE | REFERENCE EXAMPLE |
| D4 | NOT CONTAINED | 64 | 1.792 | 4.1 | NONE | REFERENCE EXAMPLE |
| D5 | NOT CONTAINED | 66 | 1.796 | 4.3 | NONE | REFERENCE EXAMPLE |
| D6 | NOT CONTAINED | 58 | 1.764 | 5.0 | NONE | COMPARATIVE EXAMPLE |
| D7 | NOT CONTAINED | 65 | 1.768 | 4.8 | NONE | REFERENCE EXAMPLE |
| D8 | NOT CONTAINED | 25 | 1.749 | 5.8 | NONE | COMPARATIVE EXAMPLE |
| D9 | CONTAINED | 26 | 1.772 | 6.2 | NONE | COMPARATIVE EXAMPLE |

Example 3

Molten steels melted in a converter were vacuum degassing treated and were adjusted to chemical compositions shown in Table 4, and then were each heated and subjected to hot rolling to be wound as a hot-rolled sheet having a thickness of 2.5 mm. In the same table, transformation temperatures of each steel, a slab heating temperature, a finish rolling finishing temperature, and a winding temperature of a hot-rolled steel sheet are shown.

more and the core loss W15/50 of 5.0 W/kg or less were evaluated to be good, and in all present invention examples, good properties were obtained.

In non-oriented electrical steel sheets each having the chemical composition falling within the range of the present invention, an excellent magnetic property was obtained. On the other hand, of comparative examples, F3 had the low average magnetic flux density B50, F6 had fracture generated in the steel sheet, and the others had a large core loss.

TABLE 4

| | STEEL | STEEL COMPOSITION (MASS %) | | | | | | | | Ar1 | Ac1 | SLAB HEATING TEMPERATURE | FINISH ROLLING FINISHING TEMPERATURE | |
|---|---|---|---|---|---|---|---|---|---|---|---|---|---|---|
| | No. | C | Si | Mn | P | Al | Sn | Sb | B | (° C.) | (° C.) | (° C.) | (° C.) | (° C.) |
| EXAMPLE | E1 | 0.003 | 0.2 | 0.2 | 0.04 | 0.6 | — | — | — | 990 | 1050 | 1250 | 1000 | Ar1 + 10 |
| | E2 | 0.003 | 1.6 | 0.2 | 0.01 | 0.005 | — | — | — | 1040 | 1100 | 1250 | 1010 | Ar1 − 30 |
| | E3 | 0.003 | 0.5 | 0.1 | 0.04 | 0.03 | — | — | — | 890 | 960 | 1150 | 910 | Ar1 + 20 |
| | E4 | 0.004 | 0.5 | 0.5 | 0.04 | 0.3 | — | — | — | 920 | 960 | 1150 | 940 | Ar1 + 20 |
| | E5 | 0.002 | 0.5 | 0.2 | 0.04 | 0.5 | — | — | — | 1030 | 1100 | 1250 | 1000 | Ar1 − 30 |
| | E6 | 0.003 | 0.5 | 0.2 | 0.1 | 0.3 | — | — | — | 940 | 1010 | 1150 | 940 | Ar1 + 0 |
| | E7 | 0.002 | 0.5 | 0.2 | 0.08 | 0.03 | 0.05 | — | — | 880 | 955 | 1150 | 890 | Ar1 + 10 |
| | E8 | 0.003 | 0.5 | 0.2 | 0.08 | 0.3 | 0.1 | — | — | 955 | 1020 | 1150 | 960 | Ar1 + 6 |
| | E9 | 0.003 | 0.5 | 0.2 | 0.08 | 0.3 | 0.16 | — | — | 950 | 1020 | 1150 | 960 | Ar1 + 0 |
| | E10 | 0.003 | 0.7 | 0.2 | 0.08 | 0.3 | 0.1 | — | — | 960 | 1050 | 1150 | 960 | Ar1 + 0 |
| | E11 | 0.003 | 1.1 | 0.2 | 0.01 | 0.3 | 0.1 | — | — | 1030 | 1120 | 1250 | 1000 | Ar1 − 30 |
| | E12 | 0.005 | 0.5 | 0.2 | 0.06 | 0.3 | — | 0.12 | — | 935 | 1000 | 1150 | 920 | Ar1 − 15 |
| | E13 | 0.004 | 0.5 | 0.2 | 0.05 | 0.03 | — | — | 0.001 | 870 | 950 | 1150 | 880 | Ar1 + 10 |
| COM-PARATIVE EXAMPLE | F1 | 0.01 | 0.5 | 0.2 | 0.07 | 0.3 | — | — | — | 955 | 1020 | 1150 | 860 | Ar1 + 5 |
| | F2 | 0.003 | 0.08 | 0.2 | 0.005 | 0.3 | — | — | — | 990 | 940 | 1150 | 890 | Ar1 + 0 |
| | F3 | 0.003 | 2.1 | 0.2 | 0.005 | 0.3 | — | — | — | — | — | 1150 | 950 | — |
| | F4 | 0.005 | 0.5 | 0.01 | 0.07 | 0.3 | — | — | — | 960 | 1020 | 1150 | 960 | Ar1 + 0 |
| | F5 | 0.003 | 0.5 | 0.8 | 0.005 | 0.3 | — | — | — | 890 | 930 | 1150 | 890 | Ar1 + 10 |
| | F6 | 0.004 | 0.5 | 0.2 | 0.2 | 0.3 | — | — | — | 950 | 1030 | 1150 | 960 | Ar1 + 0 |
| | F7 | 0.005 | 0.5 | 0.2 | 0.08 | 0.7 | — | — | — | 1060 | 1130 | 1250 | 1000 | Ar1 − 40 |

| | STEEL No. | WINDING TEMPERA-TURE (° C.) | FINISH ANNEALING TEMPERATURE AFTER COLD ROLLING (° C.) | AIN NUMBER DENSITY (PIECE/μm³) | NON-RECRYSTALIZED STRUCTURE | FERRITE GRAIN DIAMETER (μm) | B50 (T) | W15/50 (W/kg) |
|---|---|---|---|---|---|---|---|---|
| EXAMPLE | E1 | 890 | 850 | 8 | NOT CONTAINED | 48 | 1.765 | 4.5 |
| | E2 | 890 | 950 | 6 | NOT CONTAINED | 75 | 1.753 | 3.1 |
| | E3 | 790 | 900 | 3 | NOT CONTAINED | 55 | 1.769 | 4.2 |
| | E4 | 850 | 900 | 4 | NOT CONTAINED | 75 | 1.763 | 3.9 |
| | E5 | 890 | 1000 | 9 | NOT CONTAINED | 148 | 1.751 | 3.3 |
| | E6 | 820 | 900 | 3 | NOT CONTAINED | 52 | 1.765 | 4.3 |
| | E7 | 830 | 900 | 2 | NOT CONTAINED | 57 | 1.805 | 4.2 |
| | E8 | 850 | 900 | 2 | NOT CONTAINED | 53 | 1.795 | 4.0 |
| | E9 | 850 | 900 | 2 | NOT CONTAINED | 50 | 1.809 | 4.2 |
| | E10 | 850 | 900 | 3 | NOT CONTAINED | 65 | 1.786 | 3.7 |
| | E11 | 900 | 900 | 7 | NOT CONTAINED | 60 | 1.782 | 3.4 |
| | E12 | 630 | 900 | 3 | NOT CONTAINED | 58 | 1.792 | 4.1 |
| | E13 | 780 | 900 | 1 | NOT CONTAINED | 70 | 1.789 | 3.8 |
| COM-PARATIVE EXAMPLE | F1 | 850 | 900 | 9 | NOT CONTAINED | 24 | 1.748 | 5.1 |
| | F2 | 780 | 900 | 8 | NOT CONTAINED | 52 | 1.765 | 6.3 |
| | F3 | 840 | 950 | 3 | NOT CONTAINED | 73 | 1.718 | 3.2 |
| | F4 | 850 | 900 | 5 | NOT CONTAINED | 24 | 1.743 | 5.5 |
| | F5 | 850 | 950 | 8 | NOT CONTAINED | 21 | 1.732 | 6.2 |
| | F6 | 850 | COLD ROLLING FRACTURE | — | NOT CONTAINED | — | — | — |
| | F7 | 890 | 900 | 26 | NOT CONTAINED | 22 | 1.738 | 5.5 |

Thereafter, these hot-rolled steel sheets were pickled, cold-rolled to 0.5 mm, and finish annealed. In the same table, a finish annealing temperature is similarly shown.

On each of obtained materials, magnetic measurement, grain diameter measurement, and precipitate portion observation were performed, similarly to Example 1. Manufacturing conditions and measurement results are together shown in Table 4. In the evaluation this time, ones each having the average magnetic flux density B50 of 1.75 T or Example 4

Slabs each having a chemical composition containing C: 0.0011%, Si: 0.5%, Mn: 0.17%, P: 0.073%, Al: 0.31%, Sn: 0.095%, and a balance being composed of Fe and inevitable impurities were melted in a converter. Of this steel, the Ar1 transformation point was 955° C., the Ar3 transformation point was 985° C., and the Ac1 transformation point was 1018° C.

These slabs were each heated and subjected to hot rolling to be wound as a hot-rolled steel sheet having a thickness of 2.5 mm. In Table 5, a slab heating temperature, a finish rolling finishing temperature, and a winding temperature of the hot-rolled steel sheet are shown. Wound coils were maintained for 15 minutes to then be water-cooled. Some materials having a high winding temperature were heated immediately before winding.

Thereafter, the hot-rolled steel sheets were pickled, cold-rolled to 0.5 mm, and finish-annealed at each temperature shown in Table 5 for 30 seconds.

On each of obtained materials, magnetic measurement, grain diameter measurement, and precipitate portion observation were performed, similarly to Example 1. Manufacturing conditions and measurement results are together shown in Table 5. In these examples each having had Sn added thereto, when manufacturing was performed under the manufacturing conditions of the present invention, good properties of the average magnetic flux density B50 of 1.77 T or more and the core loss W15/50 of 4.5 W/kg or less were obtained.

In non-oriented electrical steel sheets manufactured by the manufacturing method falling within the range of the present invention, an excellent magnetic property is obtained. On the other hand, of comparative examples, F3 had the low average magnetic flux density B50, F6 had fracture generated in the steel sheet, and the others had a large core loss.

TABLE 5

| No. | SLAB HEATING TEMPERATURE (° C.) | FINISH ROLLING FINISHING TEMPERATURE (° C.) | (° C.) | WINDING TEMPERATURE (° C.) | FINISH ANNEALING TEMPERATURE AFTER COLD ROLLING (° C.) | HEATING IMMEDIATELY BEFORE WINDING AFTER FINISH ROLLING |
|---|---|---|---|---|---|---|
| G1 | 1280 | 1060 | Ar1 + 105 | 920 | 900 | — |
| G2 | 1250 | 1020 | Ar1 + 65 | 920 | 900 | — |
| G3 | 1150 | 960 | Ar1 + 5 | 850 | 900 | — |
| G4 | 1150 | 955 | Ar1 + 0 | 850 | 780 | — |
| G5 | 1150 | 955 | Ar1 + 0 | 850 | 1050 | — |
| G6 | 1150 | 940 | Ar1 − 15 | 850 | 900 | — |
| G7 | 1150 | 890 | Ar1 − 65 | 800 | 900 | — |
| G8 | 1150 | 960 | Ar1 + 5 | 610 | 900 | — |
| G9 | 1150 | 900 | Ar1 − 55 | 600 | 900 | — |
| G10 | 1030 | 825 | Ar1 − 130 | 630 | 900 | — |
| G11 | 1150 | 890 | Ar1 − 65 | 900 | 900 | APPLIED |
| G12 | 1150 | 890 | Ar1 − 65 | 1025 | 900 | APPLIED |

| No. | AIN NUMBER DENSITY (PIECE/μm$^3$) | NON-RECRYSTALIZED STRUCTURE | FERRITE GRAIN DIAMETER (μm) | B50 (T) | W15/50 (W/kg) | NOTE |
|---|---|---|---|---|---|---|
| G1 | 32 | NOT CONTAINED | 37 | 1.738 | 5.2 | COMPARATIVE EXAMPLE |
| G2 | 26 | NOT CONTAINED | 32 | 1.743 | 4.8 | COMPARATIVE EXAMPLE |
| G3 | 2 | NOT CONTAINED | 63 | 1.795 | 4.0 | EXAMPLE |
| G4 | 2 | CONTAINED | 22 | 1.791 | 5.8 | COMPARATIVE EXAMPLE |
| G5 | 22 | NOT CONTAINED | 18 | 1.736 | 6.2 | COMPARATIVE EXAMPLE |
| G6 | 1 | NOT CONTAINED | 73 | 1.788 | 3.8 | EXAMPLE |
| G7 | 1 | NOT CONTAINED | 85 | 1.784 | 3.5 | EXAMPLE |
| G8 | 1 | NOT CONTAINED | 28 | 1.762 | 5.6 | COMPARATIVE EXAMPLE |
| G9 | 1 | NOT CONTAINED | 39 | 1.742 | 5.1 | COMPARATIVE EXAMPLE |
| G10 | 1 | NOT CONTAINED | 28 | 1.735 | 5.2 | COMPARATIVE EXAMPLE |
| G11 | 1 | NOT CONTAINED | 92 | 1.808 | 3.8 | EXAMPLE |
| G12 | 18 | NOT CONTAINED | 17 | 1.737 | 5.9 | COMPARATIVE EXAMPLE |

(NOTICE)
Ar1 = 955° C.
Ar3 = 985° C.
Ac1 = 1018° C.

INDUSTRIAL APPLICABILITY

According to the present invention, it is possible to contribute to achievement of high efficiency of various apparatuses such as motors.

The invention claimed is:

1. A manufacturing method of a non-oriented electrical steel sheet, comprising:

on a slab having a steel composition containing, in mass %,

C: 0.005% or less,

Si: 0.2% to 0.7%,

Mn: 0.05% to 0.6%,

P: 0.100% or less,

Al: 0.5% or less, and a balance being composed of Fe and inevitable impurities, performing hot rolling to obtain a hot-rolled steel sheet;

performing cold rolling on the hot-rolled steel sheet to obtain a cold-rolled steel sheet; and performing finish annealing on the cold-rolled steel sheet, wherein;

in the hot rolling, a heating temperature of the slab is set to 1050° C. to 1250° C., a finish rolling finishing temperature is set to 850° C. to an Ar1 transformation point+20° C., and as part of the hot rolling, a coil winding temperature is set to 820° C. or higher, and an annealing temperature in the finish annealing is set to 800° C. to an Ac1 transformation point.

2. The manufacturing method of the non-oriented electrical steel sheet according to claim 1, wherein the slab further contains, in mass %, 0.05% to 0.2% of at least one of Sn and Sb.

3. The manufacturing method of the non-oriented electrical steel sheet according to claim 1, wherein the slab further contains, in mass %, 0.0005% to 0.0030% of B.

4. The manufacturing method of the non-oriented electrical steel sheet according to claim 2, wherein the slab further contains, in mass %, 0.0005% to 0.0030% of B.

* * * * *